US009957674B2

(12) United States Patent
Carrasco

(10) Patent No.: US 9,957,674 B2
(45) Date of Patent: May 1, 2018

(54) DEVICE AND METHOD FOR PRODUCING COATED PRODUCTS, FOR EXAMPLE BITUMINOUS COATED PRODUCTS, WITH PROTECTION PLATES

(71) Applicant: Antoine Carrasco, Marennes (FR)

(72) Inventor: Antoine Carrasco, Marennes (FR)

(73) Assignee: ARGUMAT, Chaponnay (FR)

( * ) Notice: Subject to any disclaimer, the term of this patent is extended or adjusted under 35 U.S.C. 154(b) by 800 days.

(21) Appl. No.: 14/373,821

(22) PCT Filed: Jan. 24, 2013

(86) PCT No.: PCT/FR2013/050149

§ 371 (c)(1),
(2) Date: Jul. 22, 2014

(87) PCT Pub. No.: WO2013/110896

PCT Pub. Date: Aug. 1, 2013

(65) Prior Publication Data

US 2015/0030767 A1 Jan. 29, 2015

(30) Foreign Application Priority Data

Jan. 25, 2012 (FR) ..... 12 50732

(51) Int. Cl.
*E01C 19/10* (2006.01)

(52) U.S. Cl.
CPC ..... *E01C 19/1027* (2013.01); *E01C 19/1022* (2013.01); *E01C 19/1036* (2013.01); *E01C 2019/109* (2013.01); *E01C 2019/1095* (2013.01)

(58) Field of Classification Search
CPC ..... E01C 19/1022; E01C 19/1027; E01C 19/1036; E01C 2019/109; E01C 2019/1095; F27B 7/14; F27B 7/22
(Continued)

(56) References Cited

U.S. PATENT DOCUMENTS 5,203,693 A * 4/1993 Swanson ..... E01C 19/05 432/115
2006/0265898 A1 11/2006 Dillman

FOREIGN PATENT DOCUMENTS

EP 0 033 812 A1 8/1981
EP 0 562 234 A1 9/1993
EP 2 281 946 A1 2/2011

OTHER PUBLICATIONS

International Search Report, dated May 8, 2013 in connection with PCT International Application No. PCT/FR2013/050149, filed Jan. 24, 2013.

* cited by examiner

*Primary Examiner* — Alexander M Weddle
(74) *Attorney, Agent, or Firm* — John P. White; Cooper & Dunham LLP

(57) ABSTRACT

The invention relates to a device for manufacturing coated materials, the device comprising:

a furnace comprising an enclosure (2) that is designed to be caused to rotate, that has an inside wall (2A) and that is provided with a main inlet (3) designed to receive non-coated new granular materials (25) or recycled granular materials (25) or a mixture of both of these types of granular materials, and an outlet for the bituminous coated materials that are manufactured inside the enclosure (2);

heater means defining a combustion zone (4) inside the enclosure (2) and generating a drying flow suitable for drying the granular materials (25); and protective means for protecting the inside wall (2A), which means are situated in the combustion zone (4);

said device being characterized in that the protective means are formed by a plurality of plates (13) that extend at some distance away from or else against the (Continued)

inside well (2A), and that are mutually overlapping in part so as to protect the inside wall (2A) thermally. Methods and devices for bituminous coated materials.

20 Claims, 2 Drawing Sheets

(58) Field of Classification Search
USPC ..... 118/47; 427/212; 432/14, 28, 103, 115
See application file for complete search history.

DEVICE AND METHOD FOR PRODUCING COATED PRODUCTS, FOR EXAMPLE BITUMINOUS COATED PRODUCTS, WITH PROTECTION PLATES

CROSS-REFERENCE TO RELATED APPLICATIONS

This application is a § 371 national stage of PCT International Application No. PCT/FR2013/050149, filed Jan. 24, 2013, claiming priority of French Patent Application No. 1250732, filed Jan. 25, 2012, the contents of each of which are hereby incorporated by reference in their entirety.

TECHNICAL FIELD

The present invention relates to the general technical field of methods and devices for manufacturing coated materials, e.g. materials coated with bitumen, such methods and devices being designed to obtain bituminous coated materials from a mass of aggregates or of solid granular materials that is made up of new and cold granulates and/or of used bituminous materials to be recycled, or indeed of a mixture of both of these two types of material, so that, after they have been dried to remove moisture, they are transformed into a finished coated material that can be used, for example, in the field of building and engineering works.

The present invention relates more particularly to a device for manufacturing coated materials, e.g. materials coated with bitumen, the device comprising:

- a furnace comprising an enclosure that is substantially cylindrical, and that is designed to be caused to rotate about its longitudinal axis by drive means, said enclosure having an inside wall and, in the vicinities of its two opposite ends, being provided firstly with a main inlet designed to receive non-coated new granular materials or recycled granular materials or a mixture of both of these types of granular materials, of the chippings or granulates type, and secondly with an outlet for the bituminous coated materials that are manufactured inside the enclosure, said granular materials flowing from the main inlet towards the outlet so as to be transformed into coated materials at the outlet, after passing through and being treated in the enclosure;
- heater means defining a combustion zone inside the enclosure and generating a drying flow suitable for drying the granular materials; and
- protective means for protecting the inside wall of the enclosure, which means are situated in the combustion zone.

The invention also relates to a method of manufacturing coated materials, e.g. materials coated with bitumen, in a rotary furnace provided with an enclosure having an inside wall and a combustion zone, and defining a circular direction and a longitudinal direction.

PRIOR ART

Devices for manufacturing coated materials, in particular bituminous coated materials, are known, and they implement a drying furnace that is generally in the form of a cylindrical body of revolution defining an enclosure having at least one inlet at one of its ends and at least one outlet at the other end, the drying furnace being driven in rotation by any suitable means while the mass of aggregates or chippings to be treated are being fed in via one end so that they advance towards the outlet end for the purpose of being treated.

Causing the enclosure to rotate thus makes it possible to cause the aggregates that enter cold and wet via the inlet to flow towards the outlet at the other end while agitating them and lifting them inside the enclosure by any suitable means, e.g. by lifting blades mounted on the inside peripheries of the walls of the enclosure.

Known furnaces also implement a heating flow generated by a burner associated with the enclosure, which burner delivers a flame in a combustion zone of the enclosure, the flame emitting a flow of hot air that, depending on the type of furnace, flows in the same direction as the direction in which the cold and wet aggregates flow inside the enclosure, or else in the opposite direction.

Finally, furnaces for manufacturing bituminous coated materials are known that operate in continuous mode or in discontinuous mode and that have heat recovery troughs that are installed in the combustion zone for protecting the inside wall of the furnace from degradation that might occur because of the heat generated by the burner and because of the wear resulting from the granulates passing through.

In such known devices, the troughs form a series of containers disposed so that they form a circular band of successive troughs over the inside wall of the furnace in the combustion zone, the troughs having overlap zones in which they cover the inside wall of the furnace in part. That configuration therefore leaves gaps between the successive troughs, allowing the granulates to pass though into the combustion zone, so that, while the furnace is rotating, the troughs continuously come to be filled in the low portion of the furnace and then to be emptied when they reach the high portion of the furnace, thereby allowing the cold granulates to be poured towards the bottom of the furnace and to start being dried while also continuing to advance inside the furnace towards the outlet zone.

The cold granulates present in the troughs thus form a cold mass along the inside wall of the enclosure, thereby thermally insulating the wall to a certain extent from the flame of the burner.

In addition, because of the wide disparity in the compositions of cold granulates, which can be new granulates or used granulates, or indeed a mixture of new and used granulates in proportions that are extremely variable, the mass of granulates does not advance uniformly and sometimes advances with difficulty so that it is often justified to provide additional devices for facilitating advance of the mass of granulates, such as propellers, for example. This complicates operation of such furnaces while also increasing their initial and maintenance costs.

Finally, devices of that type do not make it possible to solve the problem of the existence of caking phenomena that occur in the combustion zone, such caking resulting from the existence of granulates loaded with bitumen or with any other viscous substances, which granulates tend to settle and to cause general malfunctioning of the furnace, in particular because of the non-uniform temperatures present in the various zones of the furnace.

SUMMARY OF THE INVENTION

Objects assigned to the invention are, in particular, to propose a novel method and a novel device for manufacturing coated materials, e.g. and in particular bituminous coated materials, which method and which device are suitable for remedying the above-mentioned drawbacks and for improving operation of the device, in particular for reducing the risk of caking.

Another object of the invention is to propose a novel method and a novel device for manufacturing coated materials, which method and which device are suitable for providing excellent thermal protection for the device while also improving its general operation.

Another object of the invention is to propose a novel method and a novel device for manufacturing coated materials, which method and which device make it possible to treat granulate masses that are of variable and diversified compositions.

Another object of the invention is to propose a novel method and a novel device for manufacturing coated materials, which method and which device are particularly easy to implement, and facilitate cleaning and maintenance.

The objects assigned to the invention are achieved by means of a device for manufacturing coated materials, e.g. materials coated with bitumen, the device comprising:

- a furnace comprising an enclosure that is substantially cylindrical, and that is designed to be caused to rotate about its longitudinal axis by drive means, said enclosure having an inside wall and, in the vicinities of its two opposite ends, being provided firstly with a main inlet designed to receive non-coated new granular materials or recycled granular materials or a mixture of both of these types of granular materials, of the chippings or granulates type, and secondly with an outlet for the bituminous coated materials that are manufactured inside the enclosure, said granular materials flowing from the main inlet towards the outlet so as to be transformed into coated materials at the outlet, after passing through and being treated in the enclosure;
- heater means defining a combustion zone inside the enclosure and generating a drying flow suitable for drying the granular materials; and
- protective means for protecting the inside wall of the enclosure, which means are situated in the combustion zone;

said device being characterized in that the protective means are formed by a plurality of plates that extend at some distance away from or else against the inside wall, and that are mutually overlapping in part in the circular direction so as both to protect the inside wall thermally and also to lift the materials while the enclosure is rotating.

The objects assigned to the invention are also achieved by means of a method of manufacturing coated materials, e.g. materials coated with bitumen, in a rotary furnace provided with an enclosure having an inside wall and a combustion zone, and defining a circular direction and a longitudinal direction, said method being characterized in that the inside wall is thermally protected by maintaining a continuous layer of air that is of sufficient thickness in an interface 15 formed between the inside wall 2A and a plurality of plates 13 extending at some distance away from or against the inside wall 2A, said plates overlapping mutually in part both in the circular direction F1 and in the longitudinal direction.

BRIEF DESCRIPTION OF THE DRAWINGS

Other features and advantages of the invention appear and can be seen more clearly on reading the following description with reference to the accompanying drawings, given merely by way of non-limiting illustration, and in which.

BEST MANNER OF IMPLEMENTING THE INVENTION

Figure 1:
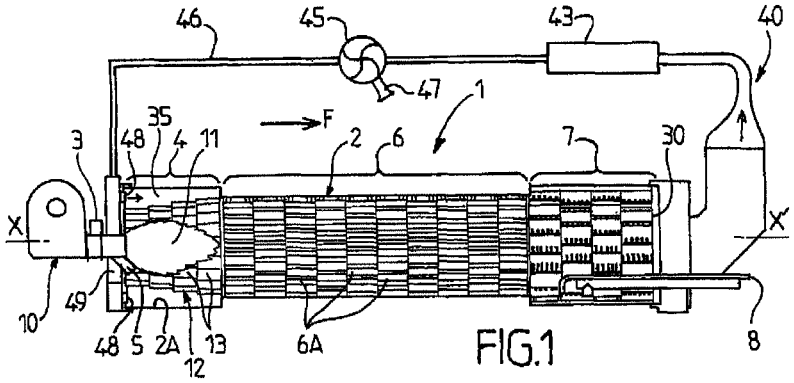
FIG. 1 is a general longitudinal section view of a device of the invention for manufacturing coated materials.

FIG. 1 is a general view of a device for manufacturing coated materials, e.g. materials coated with bitumen for manufacturing bituminous coated materials or "asphalt".

The device shown in FIG. 1 is a "parallel-current" device insofar as the heating flow F flows in the same direction as the feed and advance direction of the granular materials indicated by arrow F.

Figure 4:
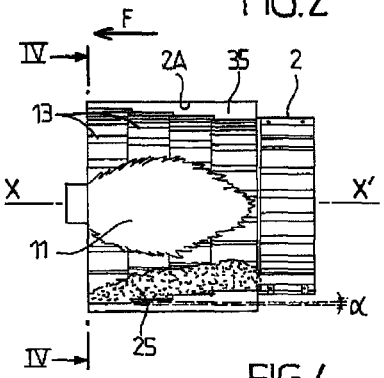
FIG. 4 is a fragmentary longitudinal section view of a second variant embodiment of a device of the invention for manufacturing coated materials.

It should however be noted that the invention is also applicable to "counter-current" devices for manufacturing coated materials, in particular bituminous coated materials, in which devices the heating flow flows in the opposite direction to the flow of the granular materials to be dried and to be transformed into bituminous coated materials (FIG. 4).

The device shown in general manner in FIG. 1 comprises a furnace 1 comprising an enclosure 2 that is substantially cylindrical, that is designed to be caused to rotate about its longitudinal axis X-X' by drive means (not shown in the figures), and that defines a circular direction and a longitudinal direction, said drive means including, in a manner known per se, an energy source, of the motor type, a series of conventional gears or drives, e.g. constituted by wheels coming into engagement with drive means secured to or integral with the outside wall of the enclosure 2.

Thus, in the meaning of the invention, the longitudinal direction corresponds to the longitudinal axis X-X', and the circular direction corresponds to both of the (clockwise or anticlockwise) directions in which the enclosure is caused to rotate.

Since the furnace 1 is designed to be caused to rotate, it constitutes a rotary furnace with an enclosure 2 made up of a plurality of successive sections, each of which has a specific function. The enclosure 2 has an inside wall 2A and, in the vicinities of its two opposite ends along the axis X-X', is provided firstly with a main inlet 3 designed to receive aggregates or non-coated new granular materials or recycled granular materials, and secondly with an outlet 30 for the bituminous coated materials that are manufactured inside the enclosure 2, said granular materials flowing from the main inlet 2 towards the outlet 3 in the longitudinal direction F so as to be transformed into coated materials in the vicinity of the outlet 3, after passing through and being treated in the enclosure 2.

In the meaning of the invention, the expression "non-coated new granular materials" means any kind of material of the aggregates, chippings, granulates, sands, or other type presenting mechanical strength sufficient for them to be used in manufacturing coated materials of all kinds that are suitable for being used as building materials in the field of engineering works, such as for building roads or walls, without such applications being limiting in any way.

Likewise, in the meaning of the invention, the expression "recycled granular materials" means any kind of materials of the aggregates, chippings, granulates, sands, or other type that has already been used as a building material, e.g. for building roads or other structures, and having already been provided with bitumen-based coating for that purpose, such materials thus being designed to be recycled for recovering their coatings or fractions of their coatings.

All of such new or recycled granular materials are thus of very heterogeneous grain size, with physical and chemical compositions that are also very heterogeneous, as well as being of very varied size, shape, moisture content, consistency etc.

In general, the rotary furnace is designed so that the new or recycled granular materials flow from the main feed inlet 2 to the outlet 30 so as to be transformed into bituminous coated materials in the vicinity of the outlet 30, after passing in succession: firstly through a combustion zone 4 into which the main inlet 3 opens out via a channel 5, then through a drying zone 6 provided with lifting blades 6A, and finally through a mixing zone 7 into which it is also possible, optionally and, for example, continuously, to inject a liquid coating material, e.g. via a tube 8 in such a manner as to produce a bituminous coated material in the vicinity of the outlet 30.

As shown, the device of the invention for manufacturing coated materials also has heater means 10 associated with the combustion zone 4 situated at the beginning of the enclosure 2. By means of a drying flame 11 generated by a burner, the heater means 10 generate a drying flow that flows in a substantially longitudinal direction F and that is suitable for drying the granular materials.

As shown in the figures, the device of the invention for manufacturing coated materials also has protective means 12 for protecting the inside wall 2A of the enclosure 2, which protective means 12 are situated in the combustion zone 4 because of the extremely high temperatures resulting from the heat emission of the flame 11.

In accordance with an important characteristic of the invention, the protective means 12 are formed by a plurality of plates 13 that extend at some distance away from or else against the inside wall 2A, and that are mutually overlapping in part both in the circular direction F1 and in the longitudinal direction, so as to protect the inside wall 2A thermally by generating a layer of air in the interface 35 formed between the inside face 2A and the plurality of plates 13.

In the examples shown in FIGS. 1 to 7, the plurality of plates 13 is disposed and extends at some distance away from the inside wall 2A so as to form an annular volume forming the interface 35 and making it possible to generate a layer of air. The plates 13 are fastened permanently by any conventional means well known to the person skilled in the art, e.g. by screw-fastening means. As shown, the interface 35 defines an annular volume of variable thickness that increases or decreases in the longitudinal direction X-X'.

More precisely, in accordance with the invention, the plates 13 overlapping in part in the circular direction, i.e. in the direction of rotation of the enclosure and in the longitudinal direction, e.g. by a few centimeters, makes it possible, in addition to thermally protecting the inside wall 2A of the enclosure 2, to prevent all or some fraction of the granular materials 25 from passing into the annular interface zone 35 extending between the inside wall 2A and the facing faces of the plates 13 in such manner as to avoid any risks of the caking phenomenon appearing.

In accordance with additional and particularly advantageous characteristics of the invention, the assembly configuration and geometrical organization of the plates 13 is such that the plates 13 form a continuous protective lining 15 protecting the inside wall 2A in the combustion zone 4 over a full section of revolution in the circular direction F1, said lining 15 including at least two continuous rows R1, R2 of plates 13 that overlap in part in the longitudinal direction X-X'.

It is thus possible to obtain a structure with partial overlaps both in the circular direction F1 and in the longitudinal direction X-X' in such a manner that a protective lining 15 is obtained that fully protects the inside wall 2A, preventing any of the hot granular materials 25 from passing through the continuous structure of the protective lining 15 towards the inside wall 2A and into the interface 35 provided between the plates 13 and the inside wall 2A.

In accordance with additional characteristics of the invention, the protective lining 15 is formed by a succession of a plurality of rows of plates 13 that overlap and that form adjacent rows of plates 13 extending in the longitudinal direction in such manner as to overlap one another in part in the circular direction and as to overlap one another in the longitudinal direction.

It is thus possible to obtain a protective lining 15 that gives full and continuous protection to the entire surface of the inside wall 2A that lies within the combustion zone when the plates 13 are mutually overlapping both in the longitudinal direction and in the circular direction, the plates 13 being side-by-side.

In accordance with the invention, the plates 13 are of identical or matching shapes, thereby making it easier to manufacture them and to mount them inside the combustion zone 4.

In accordance with a particularly advantageous characteristic of the invention, each plate 13 includes a central portion 20 with two opposite sides from which two opposite wings 21, 22 extend, on either side of the general extension plane P in which the central portion 20 extends. Thus, each wing 21, 22 extends on either side of the plane P, i.e. one of them extends above the plan P, and the other below it.

In particularly advantageous manner, the central portion 20 and the two wings 21, 22 are substantially plane or slightly curved in the circular direction so as to match the diameter of the cylindrical enclosure 2 as shown in the figures.

In particularly advantageous manner, the plane or curved central portion 20 and the two plane or curved wings 21, 22 are shaped in the form of quadrilaterals.

As shown in the figures, the plane central portion 20 is generally rectangular or square or diamond shaped, of mean dimensions respectively in the circular direction and in the longitudinal direction lying in the range 150 millimeters (mm) to 600 mm, and more precisely in the range 150 mm to 400 mm. The plane or curved wings 21, 22 are generally rectangular in shape and of mean dimensions in the circular direction lying in the range 10 mm to 50 mm.

Naturally, by way of a variant, the plates 13 may be of varying shapes and of varying geometrical dimensions and, for example, having a certain amount of curvature, or indeed be of various geometrical shapes other than quadrilaterals, the essential requirement being that they can be assembled in relation to one another in such a manner as to mutually overlap in part in the longitudinal direction and in the circular direction in order to form an effective protection for the inside wall 2A and in order to prevent granular materials 5 from passing through into the interface 35.

Figure 6:
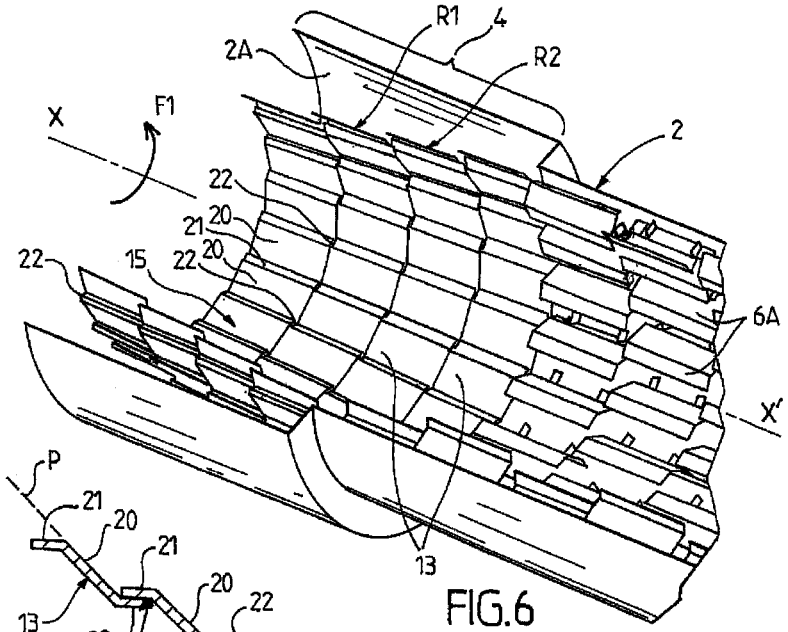
FIGS. 6 and 7 are fragmentary perspective views showing implementation details of the device of the invention for manufacturing coated materials.
Figure 7:
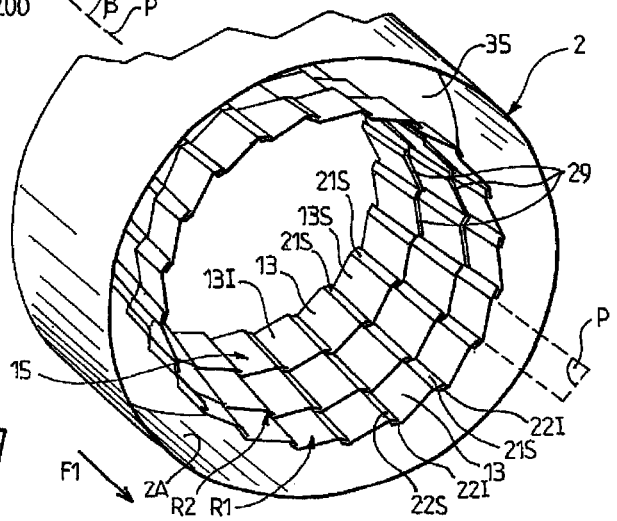

As shown in particular in FIGS. 6 and 7, the plates 13 are positioned in each row so that, in the circular direction F1, each plate 13 is connected to an "upper" neighboring plate 13S (FIG. 7) and to a "lower" neighboring plate 13I, the two wings 21, 22 of each plate 13 being disposed one above the other, thereby forming an "upper" wing 21S and a "lower" wing 211 in such a manner than the upper wing 21S of any one plate 13 covers the lower wing 211 of the upper neighboring plate and the lower wing 211 is covered by the upper wing of the lower plate and so on.

Figure 8:
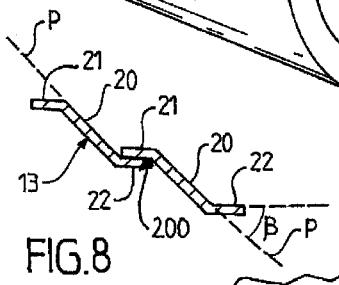
FIG. 8 is a diagrammatic cross-section view showing how the plates are assembled together in partially overlapping manner in accordance with the invention.

By means of this assembly configuration and of the configuration of each plate 13, it is thus possible to form an overlap zone between two adjacent plates that is formed by an upper wing 21 that comes to overlap a lower wing 22, thereby making it possible to prevent granular materials 25 from passing through into the interface 35 while the furnace 1 is rotating. The overlap between the lower wings 22 and the upper wings 21 shown in FIG. 8 is, however, preferably not sealed, and, for example, by construction and by assembly, a longitudinal gap 200 exists that is of small thickness and that makes it possible to generate a passageway for air or for fluid. This makes it possible to re-inject ambient air, and/or exterior air and/or recycled fumes coming from a recycling duct 46, laterally, e.g. via the annular interface 35 without disturbing the flame 11, it thus being possible for the air and/or the fumes to penetrate gently through the longitudinal gaps 200 provided between the adjacent plates 13, in the combustion zone 4. This function of generating a passageway for air or for fluid can also be performed by inter-plate transverse spaces 29, in addition to the longitudinal gaps 200 or instead of said gaps.

Merely by way of indication, the extension plane of the wings 21, 22 forms an angle β (FIG. 8) that is about 45° relative to the extension plane P of the central portion 20, which angle naturally varies depending on the diameter of the enclosure 2.

Figure 2:
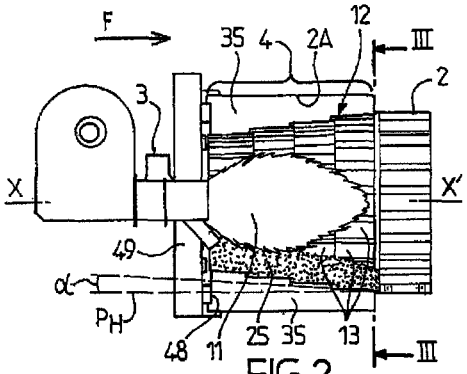
FIG. 2 is a fragmentary longitudinal section view of a first variant of a device of the invention for manufacturing coated materials.

As shown, in particular in FIGS. 2 and 4, the plurality of plates 13 forms a convergent cone (FIG. 4) or a divergent cone (FIG. 2) in the flow direction F in which the granular materials flow inside the enclosure 2.

It should be noted that the variant of FIG. 4 differs from the variant of FIG. 2 only by the convergent frustoconical shape of the combustion zone 4 used in counter-current devices instead of the divergent frustoconical shape used in parallel-current devices as shown in FIG. 2.

In a particularly advantageous version of the invention, the plates 13 are assembled together at an inclination and form an angle α (FIG. 2 or FIG. 4) corresponding to the angle formed between the horizontal plane PH and the general extension plane P of the central portion 20 of each plate.

The angle α advantageously lies approximately in the range 0° to 5°, 5° being the maximum angle that can be implemented in practice given that the shape of the plates is adapted to match the diverging or converging geometrical configuration of the cone that is formed.

The device of the invention may include a recycling system 40 for recycling the fumes produced while the coated materials are being manufactured inside the enclosure 2, said recycling system recycling the fumes into the interface 35.

In particularly advantageous manner, the recycling system 40 is connected to the outlet of the enclosure 2, and comprises a bag filter 43, extractor means 45, and a recycling duct 46 opening out into the interface 15.

FIG. 1 shows a variant of the invention in which the recycling takes place after the fumes have passed through the filter 43, the recycling duct thus being situated downstream from the baghouse filter 43. In another variant (not shown), the recycling duct is situated or mounted upstream from the baghouse filter 43.

The recycling system 40 includes an outlet tube 47 controlled by a flap for acting, as required, to direct the fumes towards the outside without recycling, or in part towards the outside and in part to recycling.

The recycling 46 may open out into the interface 35 via one or more openings 48 provided in a closure panel 49 for closing the enclosure 2 (FIG. 1 and FIG. 2).

By means of the recycling system, the fumes are burnt better, thereby contributing to reducing their toxicity while also injecting cooled gases into the interface 35 of the combustion zone 4, thereby contributing to maintaining a layer of insulating air at a low temperature at this level along the enclosure 2. This facilitates maintaining good thermal insulation, avoiding caking, and making it possible to feed the combustion zone with a mass of aggregates including a large proportion of recycled materials or indeed comprising recycled materials only, without any fear of caking.

The invention also relates to a method of manufacturing coated materials, e.g. materials coated with bitumen, in a rotary furnace provided with an enclosure having an inside wall and a combustion zone, and defining a circular direction and a longitudinal direction, said method being such that the inside wall is thermally protected by maintaining a continuous layer of air that is of sufficient thickness in an interface (35) formed between the inside wall (2A) and a plurality of plates (13) extending at some distance away from or against the inside wall (2A), said plates overlapping mutually in part both in the circular direction (F1) and in the longitudinal direction X-X'.

Figure 3:
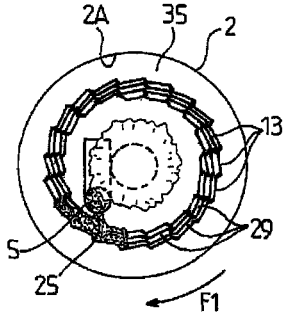
FIG. 3 is a cross-section view, on line of FIG. 2, of the first variant embodiment of a device of the invention for manufacturing coated materials.

In advantageous manner, the method is such that the layer of air is maintained by recycling, directly into the interface 35, all or some part of the fumes resulting from manufacturing the coated materials. The frustoconical shape of the array of plates 13 facilitates renewal of the layer of air that can flow by leaking through the above-mentioned inter-plate spaces 29 (FIGS. 3 and 7).

The device of the invention for manufacturing coated materials operates as follows:

With the heater means 10 being activated and delivering a flame 11, and the furnace being caused to rotate in the direction F1, the coated materials 25 can be brought into the combustion zone 4 via the main inlet 3.

The non-coated new granular materials 25 or the recycled granular materials 25, or a mixture of both types, then come to be poured in via the pipe 5 at the beginning of the combustion zone 4 inside which the protective lining 15 made up of the plates 13 is, like the remainder of the enclosure, caused to rotate.

Figure 5:
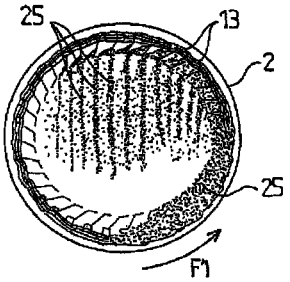
FIG. 5 is a cross-section view, on line V-V of FIG. 4, of a device of the invention for manufacturing coated materials, which device corresponds to the second variant embodiment.

As shown, in particular, in FIG. 5, the enclosure 2 and, in particular the truncated cone formed by the plurality of partially overlapping plates 13, being caused to rotate makes it possible to cause the granular materials 25 to advance progressively and to cause them to move in circular manner to a small extent in the low zone by means of the wings 21, 22 positioned in mutually overlapping manner forming a series of successive steps or terraces. The granular materials 25, while advancing continuously as indicated by arrow F inside the enclosure 2 in the longitudinal direction, are constantly agitated at the bottom of the combustion zone 4 while also advancing continuously inside the rotary furnace to reach the drying zone 6 and then finally the mixing zone 7. Recycling the fumes sucked up by the extractor means 45, of the fan type, continuously renews the layer of air, thereby reinforcing its insulating effectiveness.

Naturally, while the granular materials 25 are advancing inside the rotary furnace, they are progressively dried and then coated in the mixing zone 7 by being put in contact with the bitumen and/or with other coating ingredients.

The use of a plurality of plates 13 that are mutually overlapping in part both in the circular direction and in the longitudinal direction to form a sort of protective lining of doubly overlapping scales or shingles forces the granulates to remain constantly above the plates 13, thereby avoiding any caking, since the movement of the granulates is constant in all geometrical directions.

This makes it possible to have a large degree of freedom in the composition of the granular materials 25 feeding the combustion zone 4, it being possible for the granular materials 25 to be new and cold and/or used bituminous materials, or indeed a mixture of the two types of material, it being possible for the proportion to lie in the range 0% to 100%. Thus, the manufacturing device of the invention can, without any risk of caking, manufacture bituminous materials from 0% new and cold granular materials and from 100% used and therefore recycled bituminous materials, or from a mixture of the two in any proportion.

The device of the invention also makes it possible to limit considerably the wearing zones of the enclosure 2 in general, and to facilitate maintenance of the device as a whole. It is possible to change only one or a few plates 13 in the event of wear, without having to change all of the parts making up the combustion zone 4.

Finally, since the neighboring plates 13 in the array of plates 13 overlap mutually in two directions in three-dimensional space, they deliver good thermal insulation for the inside wall 2A of the furnace by forming a continuous layer of air over the entire inside surface of the enclosure inside the interface 35.

Finally, this device makes it possible to omit additional devices for injecting used bituminous materials that are to be recycled, such additional devices generally being situated downstream from the flame 11 in prior art devices. The absence of the usual caking phenomenon appearing in the combustion zone 4 as a result of the device of the invention makes it possible for the combustion zone 4 to be fed directly with a very high proportion of recycled granular materials or indeed with such recycled materials only.

SUSCEPTIBILITY OF INDUSTRIAL APPLICATION

The invention is industrially applicable to design and use of methods and devices for manufacturing coated materials, e.g. bituminous coated materials.

The invention claimed is:

1. A device for manufacturing coated materials, including materials coated with bitumen, the device comprising:

a furnace (1) comprising an enclosure (2) that is substantially cylindrical, that is designed to be caused to rotate about a longitudinal axis (X-X') of the enclosure (2) by drive means, and that defines a circular direction (F1) and a longitudinal direction (F), said enclosure (2) having an inside wall (2A) and two opposite ends in the longitudinal direction (F), the first opposite end being provided with a main inlet (3) designed to receive non-coated new granular materials (25) or recycled granular materials (25) or a mixture of both of these types of granular materials, of the chippings or granulates type, and the second opposite end being provided with an outlet (30) for the bituminous coated materials that are manufactured inside the enclosure (2), said granular materials (25) being treated while flowing from the main inlet (3) towards the outlet (30) in the enclosure (2) and being transformed into coated materials at the outlet (30);

heater means (10) defining a combustion zone (4) inside the enclosure (2) and generating a drying flow suitable for drying the granular materials (25); and protective means for protecting the inside wall (2A) of the enclosure (2), which means are situated in the combustion zone (4);

wherein the protective means is formed by a plurality of plates (13) that extend at some distance away from, or against, the inside wall (2A), and at least one pair of adjacent plates (13) amongst the plurality of plates (13) are mutually overlapping in part both in the circular direction (F1) and in the longitudinal direction (F), to protect the inside wall (2A) thermally, by generating a continuous layer of air in an interface (35) formed between the inside wall (2A) and the plurality of plates (13).

2. A device according to claim 1, wherein the plates (13) form a continuous protective lining (15) that protects the inside wall (2A) in the combustion zone (4) over a full section of revolution in the circular direction (F1), said lining comprising at least two continuous rows of plates (13) that overlap in part in the longitudinal direction (F).

3. A device according to claim 2, wherein the plates (13) are of identical or matching shapes and dimensions.

4. A device according to claim 2, wherein the protective lining (15) is made up of a succession of a plurality of rows of overlapping plates forming adjacent rows of plates (13) extending in the longitudinal direction (F).

5. A device according to claim 4, characterized in that the plates (13) are of identical shapes and dimensions.

6. A device according to claim 1, wherein the plates (13) are of identical shapes and dimensions.

7. A device according to claim 6, wherein each plate (13) has a central portion (20) with two opposite sides from which two wings (21, 22) extend on either side of a general extension plane (P) of the central portion (20).

8. A device according to claim 1, wherein each plate (13) has a central portion (20) with two opposite sides from which two wings (21, 22) extend on either side of a general extension plane (P) of the central portion.

9. A device according to claim 8, wherein the central portion (20) and the two wings (21, 22) are substantially planar.

10. A device according to claim 9, wherein the central portion (20) and the two wings (21, 22) are quadrilateral-shaped.

11. A device according to claim 8, wherein the central portion (20) and the two wings (21, 22) are quadrilateral-shaped.

12. A device according to claim 8, wherein the plates (13) are positioned in each row so that, in the circular direction (F1), each plate (13) is connected to an upper neighboring plate (13S) and to a lower neighboring plate (13I), the two wings (21, 22) of each plate (13) being disposed one above the other, thereby forming an upper wing (21S) and a lower wing (22I) in such a manner than the upper wing (21S) of any one plate (13) covers the lower wing (22I) of the upper neighboring plate (13S) and the lower wing (22I) is covered by the upper wing (21S) of the lower plate.

13. A device according to claim 8, wherein an extension plane of each of the wings (21, 22) forms an angle β with the extension plane (P) of the central portion (20).

14. A device according to claim 1, wherein the plurality of plates (13) form a convergent or divergent cone.

15. A device according to claim 14, wherein, within the cone, the plates (13) are assembled at an inclination and form an angle α corresponding to an angle formed between a horizontal plane and an extension plane of a central portion (20) of each plate.

16. A device according to claim 15, wherein the angle α lies in the range 0° to 5°.

17. A device according to claim 1, further comprising a recycling system (40) for recycling fumes produced during manufacturing of the coated materials in the enclosure (2), said system recycling the fumes into the interface (15).

18. A device according to claim 17, wherein the recycling system (40) is connected to the outlet of the enclosure (2) and comprises a filter (43), extractor means (45) and a recycling duct (46) opening out into the interface (15).

19. A method of manufacturing coated materials, including materials coated with bitumen, in a rotary furnace (1) provided with an enclosure (2) having an inside wall (2A) and a combustion zone (4) and defining a circular direction (F1) and a longitudinal direction (F), the method comprising:

protecting the inside wall 2(A) of the enclosure (2) thermally with a plurality of plates (13) extending at some distance away from, or against, the inside wall (2A), at least one pair of adjacent plates (13) amongst the plurality of plates (13) mutually overlapping in part both in the circular direction (F1) and in the longitudinal direction (F), to maintain a continuous layer of air that is of sufficient thickness in an interface (35) formed between the inside wall (2A) and the plurality of plates (13);

treating granular materials (25) flowing from a main inlet (3), at a first opposite end of the enclosure (2) in the longitudinal direction (F), towards an outlet (30), at a second opposite end of the enclosure (2) in the longitudinal direction (F);

generating a drying flow suitable for drying the granular materials (25) in the combustion zone (4) inside the enclosure;

transforming the granular materials into coated materials at the outlet (30).

20. A method according to claim 19, wherein the layer of air is maintained by causing all or some fraction of fumes resulting from manufacturing the coated materials to be recycled directly into the interface (35).

* * * * *